US008240661B2

(12) United States Patent
Bober

(10) Patent No.: US 8,240,661 B2
(45) Date of Patent: Aug. 14, 2012

(54) CROSS PROCESS SHUTTERING OF A VACUUM TRANSPORT SYSTEM

(75) Inventor: Henry T Bober, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 229 days.

(21) Appl. No.: 12/434,723

(22) Filed: May 4, 2009

(65) Prior Publication Data

US 2010/0276879 A1 Nov. 4, 2010

(51) Int. Cl.
*B65H 29/24* (2006.01)

(52) U.S. Cl. ..... 271/194; 271/276; 271/197

(58) Field of Classification Search ..... 271/196, 271/194, 197, 276, 96, 108
See application file for complete search history.

(56) References Cited

U.S. PATENT DOCUMENTS 4,412,738 A * 11/1983 Ahern et al. ..... 271/197
4,456,242 A * 6/1984 Morin ..... 271/94
6,505,030 B1 1/2003 Santiago et al.
6,571,702 B2 * 6/2003 Wotton et al. ..... 101/232
7,296,792 B2 * 11/2007 Kondratuk et al. ..... 271/197

FOREIGN PATENT DOCUMENTS

JP 60-19637 * 1/1985
JP 6-9083 * 1/1994
JP 2001-316011 * 11/2001

OTHER PUBLICATIONS

English translation of Detailed Description section of Japanese Publication No. 6-9083.*

* cited by examiner

*Primary Examiner* — Gerald McClain
*Assistant Examiner* — Thomas Morrison

(57) ABSTRACT

A vacuum transport system includes vacuum plenum having a plenum plate as a part thereof and a belt with an array of holes that align to grooves in the plenum plate over which the belt is driven. A sliding plate on the underside of the plenum plate inside the vacuum plenum contains a series of holes and slots to progressively open or shut holes connecting the grooves to the vacuum plenum to maintain a constant air flow and vacuum pressure in the cross process direction for varying widths of media.

17 Claims, 4 Drawing Sheets

CROSS PROCESS SHUTTERING OF A VACUUM TRANSPORT SYSTEM

This disclosure relates to paper handling systems, and more specifically, to an improved vacuum transport that holds down and transports media through the print zone of a printer.

A typical vacuum transport configuration is shown in prior art FIG. 1. As shown in the Figure, the vacuum transport generally indicated as 100 is disposed within a copier or printer between a photoreceptor 102 and the fuser rolls 104. Vacuum transport 100 typically comprises a porous or holed belt 110 which is entrained about two rollers 112, 114. This belt 110 typically defines a number of small holes therein (not shown). Disposed inside the belt 110 is a vacuum chamber 116. The vacuum chamber 116 is actuated by a vacuum blower 118 and thereby draws air through the holes in belt 110 particularly in the area where a sheet moving in a process direction is passing over the belt 110. Thus, vacuum chamber 116 holds a sheet against the outer surface of belt 110, while belt 110 moves that sheet from photoreceptor 102 toward the nip of fuser rolls 104.

In U.S. Pat. No. 6,505,030 a vacuum transport is shown that allows for varying air pressure on a sheet responsible to sensed sheet parameters, such as, weight and size with the use of multiple plates in a vacuum plenum and a sensor. This patent is included in its entirety herein by reference.

In ink jet printing, and especially in UV coater printing, the transport hold down function is one part of the printing system that is used to establish and control the critical media print surface to ink jet print head gap in the range of 1.0 mm to ±0.2 mm. This is an extremely tight tolerance, especially over an area that can be two square feet or more. Ordinarily, vacuum transports have traditionally solved this problem localizing vacuum hole patterns and overpowering the system with larger vacuum blowers. However, the flow losses around 'smaller' or undersized media can be substantial thereby reducing the vacuum and the vacuum hold down effectiveness. In addition, increasing blower capacity will likely produce higher plenum chamber pressures when 'full sized' media is present. Further, media and belt distortion become a concern and transport drag torque will be increased. These result in increased cost, power, noise, environmental disruption, media distortion, drag force variations and overall decreased latitude.

In answer to these problems and disclosed herein is a vacuum transport that includes a belt with an array of holes that align to process direction grooves in a vacuum plenum plate positioned across the top of the vacuum chamber. Sliding aperture plates on the underside of the plenum plate inside the vacuum plenum contain a series of specifically contoured holes and slots to progressively open or shut holes connecting the grooves to the vacuum plenum to control air flow and vacuum pressure in the cross process direction for varying widths of media.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
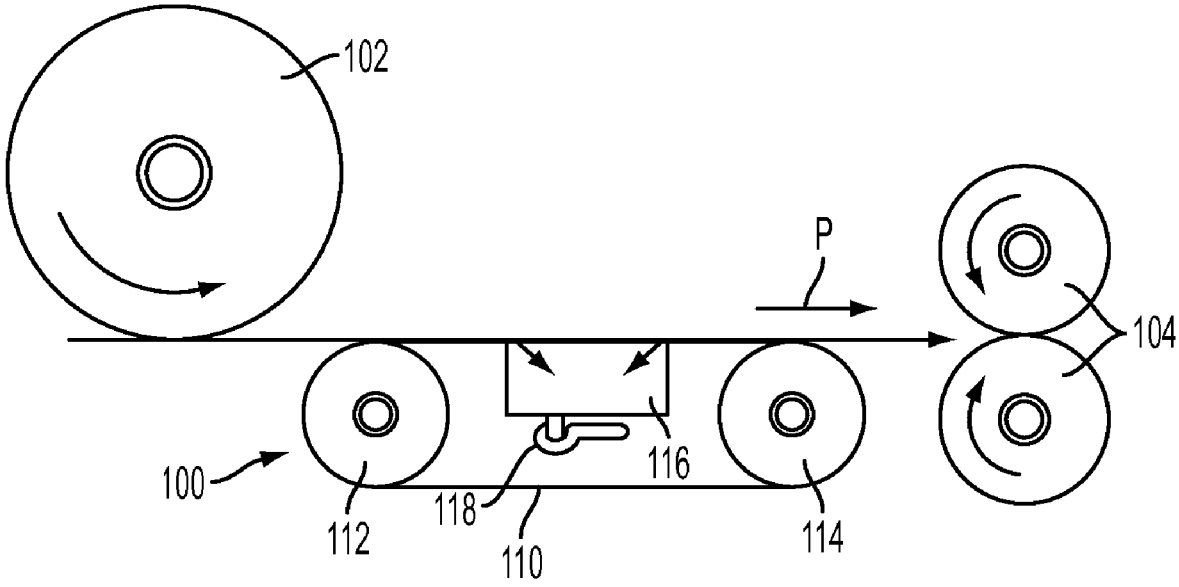
FIG. 1 PRIOR ART
FIG. 1 is a side view of a prior art xerographic printer vacuum transport.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment ink jet printing apparatus that includes a method and apparatus that minimizes flow losses with smaller media.

For a general understanding of the features of the disclosure, reference is made to the drawings. In the drawings, like reference numerals have been used throughout to identify identical elements.

Figure 2:
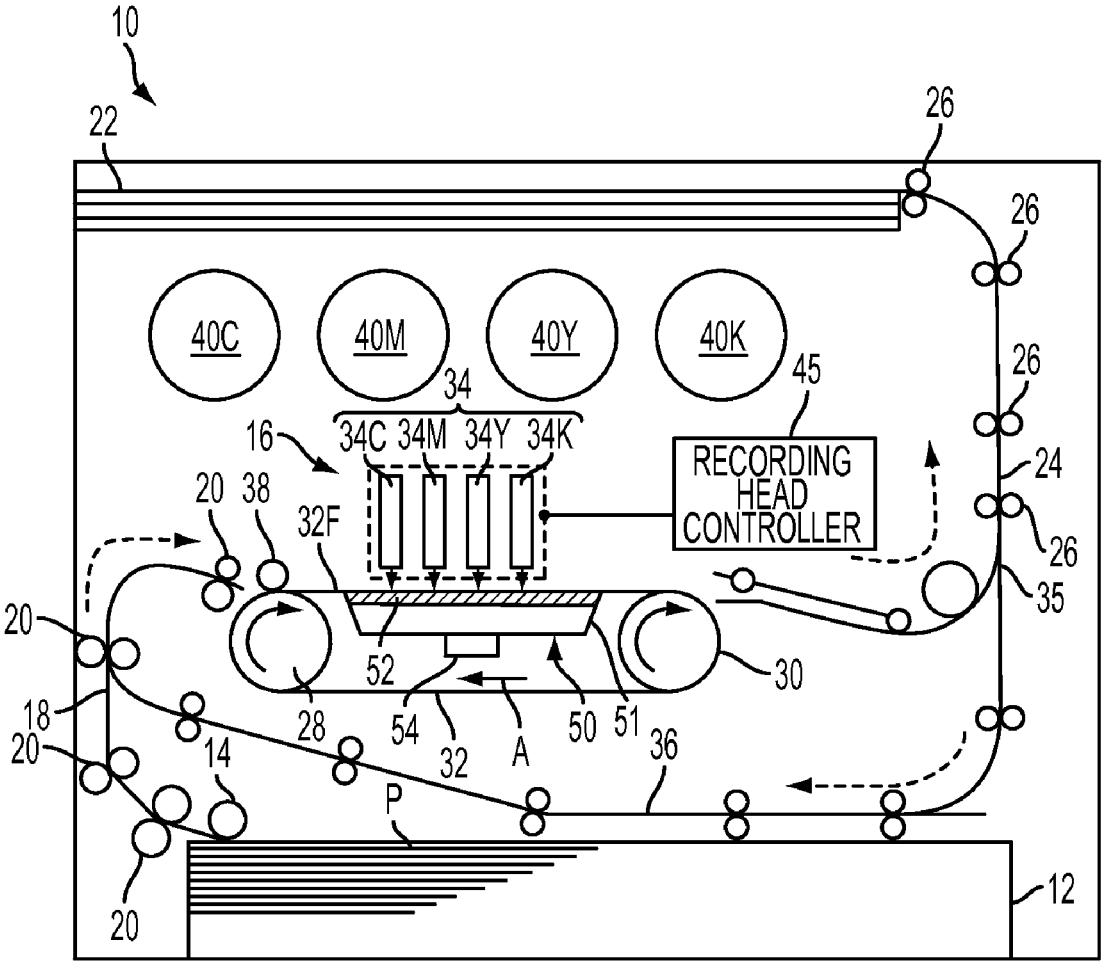
FIG. 2 is a side view of an exemplary ink jet printer that employs a vacuum transport that includes a vacuum plenum in accordance with the present disclosure.

Referring now to printer 10 in FIG. 2, the ink jet printer 10 is disposed with a paper supply cassette 12 in which paper or recording media P is accommodated. A feed roll 14 that pressingly contacts the leading end portion of the upper surface of the paper P and removes the paper P from the paper supply cassette 12 is disposed on the upper portion of the leading end side of the paper supply cassette 12.

The ink jet printer 10 includes a first conveyance path 18 that extends from the leading end portion of the paper supply of the paper supply cassette 12 and leads to a recording section 16, which conducts image recording on the paper P. Plural fist conveyance roller pairs 20 that constrain and convey the paper P to the recording section 16 are disposed on the first conveyance path 18.

The inkjet printer 10 also includes a second conveyance path 24 that extends upward from the recording section 16 and leads to a paper discharge tray 22, which accommodates the paper P on which an image has been recorded. Plural secondary roller pairs 26 that convey the paper P to the paper discharge 22 are disposed on the second conveyance path 24. An inverse conveyance path 36 for conducting two sided printing connects the second conveyance path 24 to the first conveyance path 18.

In operation, the paper P is removed from the paper supply cassette 12 by the feed roll 14, conveyed on the first conveyance path 18 by the plural conveyance roller pairs 20, and fed to the recording section 16, where image recording is conducted. When an image has been recorded on the paper P, the paper P is conveyed on the second conveyance path 24 by the plural conveyance roller pairs 26 and discharged into the paper discharge tray 22. When two-sided printing is to be conducted, an image is first recorded on one side of the paper P, and then the paper P is inverted at the junction 35 of paths 24 and 36 and is conveyed from the second conveyance path 24 to the first conveyance path 18 via the inverse conveyance paper path 36 and is again fed to the recording section 16, where image recording is conducted on the other side of the paper P. Thus, successive image recording is conducted.

The recording section 16 includes an endless conveyor belt 32 that includes a number of small holes (not shown) therein is wound around a drive roller 28 disposed upstream in the paper conveyance direction and a driven roller 30 disposed downstream in the paper conveyance direction. The conveyor belt 32 is configured such that it is circulatingly driven in the direction of arrow A. A nip roller 38 that slidingly contacts the surface of the conveyor belt 32 is disposed on the upper portion of the drive roller 28. A vacuum plenum 50 is positioned inside belt 32 and connected to a vacuum source 54 adapted to apply vacuum pressure to the holes in conveyor belt 32 in order to attach paper P to vacuum platen 52 during recording by the recording section 16.

An ink jet recording head 34 is disposed above the conveyor belt 32. The ink jet recording head 34 is configured to be long, such that its effective recording area is approximately equal to or greater than the cross process direction width of the paper P. The ink jet recording head 34 includes at least four ink jet recording heads 34C, 34M, 34Y and 34K, which respectively, correspond to the four colors Yellow (Y), magenta (M), cyan (C) and black (K). The ink jet recording heads 34C, 34M, 34Y and 34K are disposed along the conveyance direction; thus, the ink jet recording head 34 can record a full-color image.

The ink jet recording head 34 faces a flat portion 32F of the conveyance belt 32, and this facing area serves as an ejection areas to which ink droplets are ejected from the ink jet recording head 34. The paper P conveyed on the first conveyance path 18 is retained and held flat to the conveyor belt flat portion 32F by force of vacuum and sent to the ejection region, where the ink droplets corresponding to the image are ejected from the inkjet recording head 34 and onto the paper P in a state where the paper P faces the ink jet recording head 34.

Ink tanks 40C, 40M, 40Y and 40K, which supply the inks to the ink jet recording heads 34C, 34M, 34Y and 34K are disposed above the ink jet recording head 34.

The ink jet recording heads 34C, 34M, 34Y and 34K are connected to a recording head controller 45. The recording head controller 45 controls the ink jet recording head 34 by determining the ejection timing of the ink droplets and the processing liquid, and the ink ejection ports or nozzles to be used, in accordance with image information, and inputting a drive signal to the ink jet recording heads 34C, 34M, 34Y and 34K.

Figure 3:
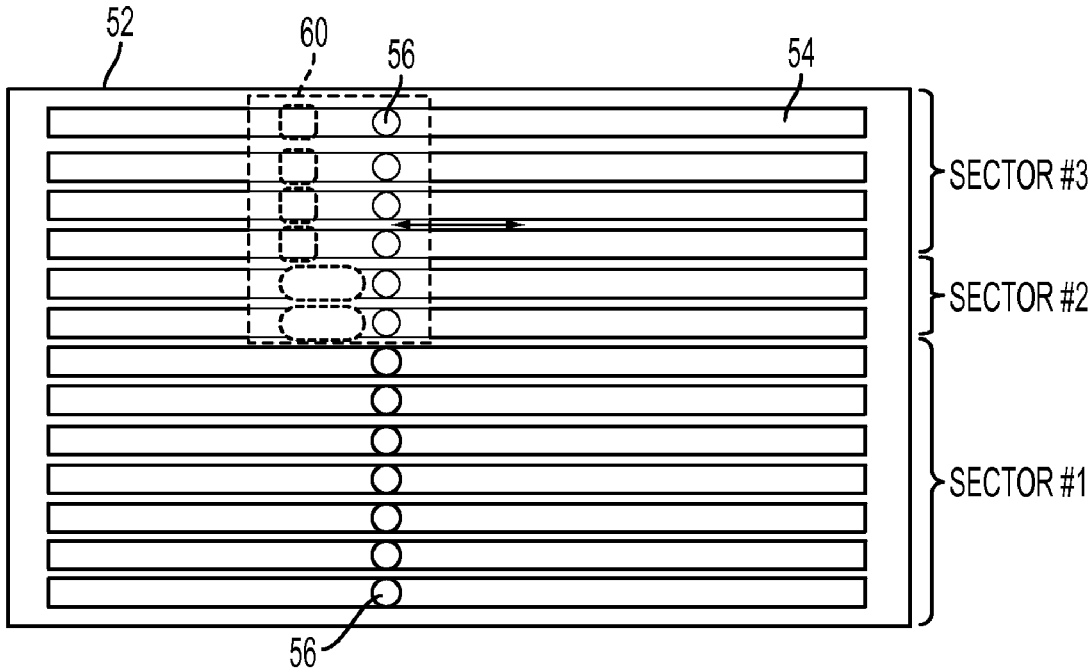
FIG. 3 is a bottom view of a shutter plate positioned underneath a grooved vacuum plenum plate of the vacuum plenum of FIG. 2 with the shutter plate in a first position.
Figure 4:
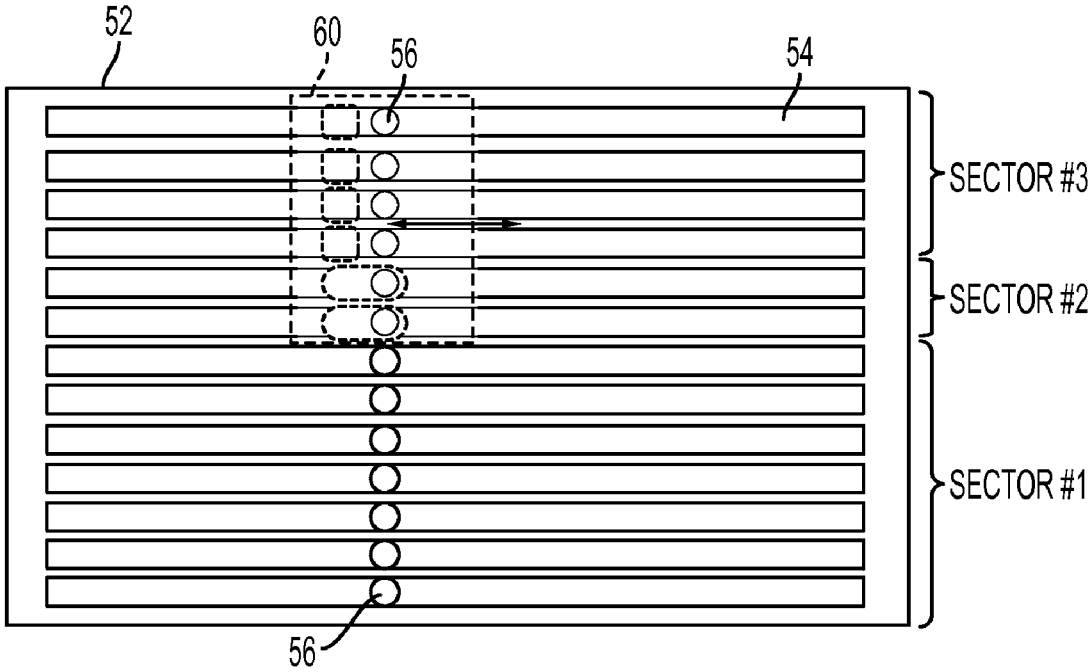
FIG. 4 is a bottom view of the shutter plate of FIG. 3 positioned in a second position.
Figure 5:
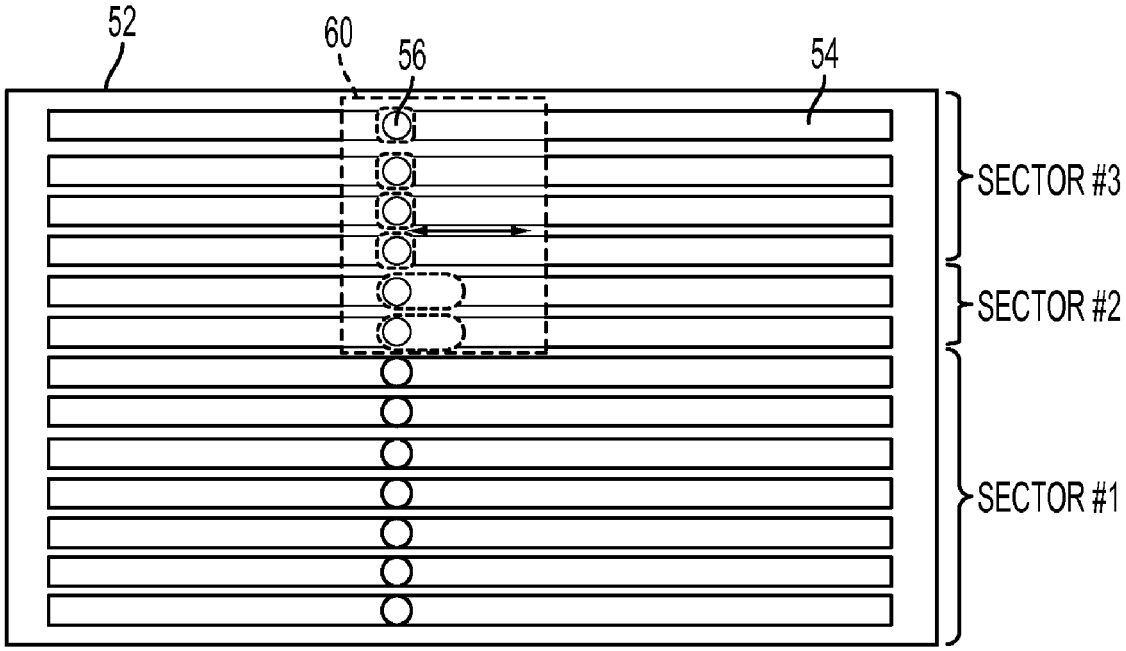
FIG. 5 is a bottom view of the shutter plate of FIG. 3 positioned in a third position.
Figure 6:
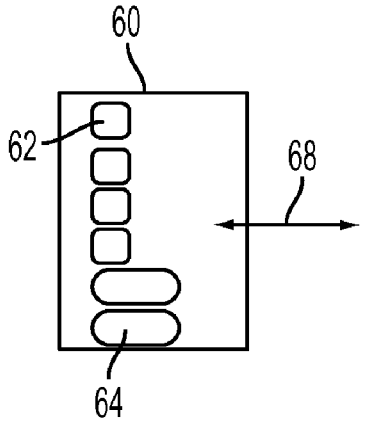
FIG. 6 is a plan view of the shutter plate of FIG. 3.

In accordance with the present disclosure and shown in FIG. 3 vacuum transport 50 includes a vacuum plenum 51 with a plenum plate 52 attached thereto that has multiple process direction grooves 54 therein. The plenum plate 52 has holes 56 therein that communicate with holes (not shown) in conveyor belt 32 in order to apply vacuum pressure to paper P conveyed over plenum plate 52. Plenum plate 52 includes grooves 54 with holes 56 positioned within the grooves. A shutter plate 60 is positioned underneath plenum plate 52 and is movable by conventional means (not shown), such as, a motor and lead screw, motor and cam, motor and linkage, solenoids, a rack and pinion mechanism, or other suitable means in the direction of arrow 68 shown in FIG. 6. Shutter plate 60 contains a series of holes 62 that have a larger diameter than the holes 56 in the plenum plate 52 and slots 64 that are elongated in the process direction. The shuttle plate holes and slots are arranged to allow the progressive opening/closing of a wider/narrow section of the plenum plate and are larger than plenum plate holes 56 to allow for tolerances and driver errors. That is, movement of shutter plate 60 divides plenum plate 52 into distinct Sectors 1, 2 and 3 of holes communicating with vacuum plenum 51. Sector 1 is, for example, used for coverage of letter/A4 short edge fed media while Sector 2 is used, for example, to cover letter/A-4 long edge fed media and tabloid/A-3 short edge fed media. Sector 3, for example, accommodates larger media such as B-3 short edge fed media. For example, for narrow media, the shutter is positioned as shown in FIG. 3 such that selected holes in the plenum plate 52 are closed and vacuum pressure acts only over a sheet that covers Sector 1 which is active. In FIG. 4, shutter plate 60 has been moved to a second position in order to make Sector 2 additionally active in the cross process direction of plenum plate 52 and thereby allow vacuum pressure to be applied to and thereby accommodate wider media positioned on plenum plate 52. In FIG. 5, shutter plate 60 has been moved to allow vacuum pressure access to holes in plenum plate 52 in Sector 3 in order to accommodate media of a predetermined maximum width. Thus, as the media width increases, the shutter plate is moved in the direction of arrow 68 in FIG. 6 and successive holes of the row of holes in plenum plate 52 are opened and a wider portion of vacuum transport belt 32 becomes active. In this way, flow loss around undersized media is controlled or reduced and blower size is minimized.

It should now be understood that a vacuum transport system has been disclosed that employs a movable shutter valve which works in conjunction with a plenum plate of a vacuum plenum in order to enable cross process direction customization of active areas of a vacuum belt that is in communication with the plenum plate for a vacuum hold down transport of media and thereby minimize flow losses with smaller sized media. In addition, the system reduces noise, lowers power requirements, reduces unit manufacturing cost and lowers energy consumption. Further, more consistent media hold down across a wide range of media sizes is accommodated, as well as, increased system latitude.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A printing apparatus, comprising:

a vacuum belt module including a belt support for supporting a movable continuous belt around a vacuum plenum assembly;

a sheet feeder for supplying and moving an image receiving sheet through said vacuum belt module;

an imaging apparatus for forming an image on said image receiving sheet; and a vacuum transport system, said vacuum transport system including a vacuum transport and said vacuum plenum assembly, said vacuum plenum assembly including a vacuum plenum and at least a portion thereof positioned within said vacuum belt module and a grooved plenum plate covering said vacuum plenum and facing an underside portion of said continuous belt, said plenum plate including a series of holes therein extending in a single line in a cross process direction and a series of grooves extending in a process direction, and wherein said vacuum transport includes a single and unitary shutter plate positioned within said vacuum plenum assembly and beneath said plenum plate, said shutter plate being adapted to move forward in said process direction and in reverse to said process direction in a horizontal plane to thereby block and unblock a predetermined number of said series of holes in said plenum plate in accordance with the size of image receiving sheet being conveyed by said sheet feeder to said vacuum transport, said shutter plate being stationary when said image receiving sheet is fed past said plenum plate, and wherein said series of holes in said plenum plate are located within said grooves of said plenum plate and extend beyond said shutter plate in said cross process direction.

2. The printing apparatus of claim 1, wherein said shutter plate includes a series of holes and slots that are configured such that movement of said shutter plate in said process direction causes said slots to be exposed to said holes in said plenum plate to accommodate a particular sheet size before said holes in said shutter plate are exposed to said holes in said plenum plate to accommodate a different sheet size.

3. The printing apparatus of claim 2, wherein said holes in said shutter plate are larger than said holes in said plenum plate.

4. The printing apparatus of claim 3, wherein said slots in said shutter plate are elongated in the process direction and positioned adjacent only one side portion of said shutter plate.

5. The printing apparatus of claim 4, including a vacuum source connected to said vacuum plenum.

6. The printing apparatus of claim 5, wherein said holes and slots in said shutter plate are adapted to progressively open or shut holes connecting said grooves in said plenum plate to the vacuum plenum to control air flow and vacuum pressure in the cross process direction for varying widths of image receiving sheets before said image receiving sheets are fed past said vacuum plenum, and wherein a majority of said holes in said plenum plate remain uncovered by said shutter plate during movement for sheet size adjustment.

7. The printing apparatus of claim 6, wherein said shutter plate is adapted to divide an active area of said plenum plate for receiving vacuum pressure into distinct sectors.

8. The printing apparatus of claim 7, wherein said distinct sectors corresponds to predetermined sheet widths.

9. The printing apparatus of claim 8, wherein said shutter plate includes only two elongated slots and four circular holes.

10. The printing apparatus of claim 1, wherein said imaging apparatus is an ink jet module.

11. The printing apparatus of claim 1, wherein said shutter plate is positioned before said image receiving sheet is fed.

12. The printing apparatus of claim 2, wherein all of said holes in said shutter plate when in a first position are not in air flow communication with said holes in said plenum plate so that only said holes in said plenum plate are in communication with said vacuum plenum to thereby simultaneously apply vacuum control to particular sized sheets.

13. The printing apparatus of claim 12, wherein all of said slots in said shutter plate when said shutter plate is in said first position are not in air flow communication with said holes in said plenum plate.

14. The printing apparatus of claim 13, wherein only said slots in said shutter plate are in air flow communication with said holes in said plenum plate when said shutter plate is in a second position.

15. The printing apparatus of claim 14, wherein said holes and said slots in said shutter plate are in air flow communication with said holes in said plenum plate when said shutter plate is in a third position.

16. The printing apparatus of claim 15, wherein said single line of holes in a first sector of said plenum plate are active beyond a boundary of said shutter plate in said cross process direction when said shutter plate is in said first position and holes in said first and a second sector of said plenum plate are active when said shutter plate is in said second position.

17. The printing apparatus of claim 16, wherein holes in said first, second and a third sector of said plenum plate are active when said shutter plate is in said third position.

* * * * *